United States Patent [19]

Heck et al.

[11] Patent Number: 4,643,337

[45] Date of Patent: Feb. 17, 1987

[54] DISPENSER FOR VISCOUS MATERIALS

[75] Inventors: Paul Heck, Worcester; Eugene F. Haffner, Philadelphia, both of Pa.

[73] Assignee: Hex Plastics, Inc., Telford, Pa.

[21] Appl. No.: 665,038

[22] Filed: Oct. 26, 1984

[51] Int. Cl.[4] ..... B67D 5/42

[52] U.S. Cl. ..... 222/214; 222/336; 222/391

[58] Field of Search ..... 222/391, 510, 213, 518, 222/150, 336, 405, 214

[56] References Cited

U.S. PATENT DOCUMENTS

| | | | |
|---|---|---|---|
| 949,545 | 2/1910 | Muller | 222/391 X |
| 1,212,010 | 1/1917 | Brown | 222/391 X |
| 1,244,324 | 10/1917 | Hackley | 222/391 X |
| 1,668,511 | 5/1928 | McLaughlin | 222/391 X |
| 1,921,912 | 8/1933 | De Philipps | 221/78 |
| 1,951,107 | 3/1934 | Parker | 222/213 |
| 2,151,684 | 3/1939 | Casella | 221/78 |
| 2,243,774 | 5/1941 | Resh | 221/78 |
| 2,488,638 | 11/1949 | O'Connor | 222/391 X |
| 2,490,721 | 12/1949 | Via | 222/518 X |
| 2,557,952 | 6/1951 | Dumont | 222/387 |
| 2,604,858 | 7/1952 | Bosa | 107/14 |
| 2,732,101 | 1/1956 | Sohn | 222/320 |
| 3,088,636 | 5/1963 | Spatz | 222/213 |
| 3,215,320 | 11/1965 | Heisler et al. | 222/391 |
| 3,255,935 | 6/1966 | Spatz | 222/340 |
| 3,361,305 | 1/1968 | Spatz | 222/207 |
| 3,558,059 | 1/1971 | Pfaff et al. | 222/213 X |
| 3,768,705 | 10/1973 | Spatz | 222/213 |
| 4,154,371 | 5/1979 | Kolaczinski et al. | 222/212 |
| 4,301,948 | 11/1981 | Czech et al. | 222/341 |
| 4,413,759 | 11/1983 | Mettenbrink | 222/213 |
| 4,421,255 | 12/1983 | Czech | 222/387 |
| 4,437,584 | 3/1984 | Connors et al. | 222/137 |
| 4,437,591 | 3/1984 | von Schuckmann | 222/391 |
| 4,461,403 | 7/1984 | Prahs | 222/129 |
| 4,477,001 | 10/1984 | Galia | 222/518 X |

*Primary Examiner*—Joseph J. Rolla
*Assistant Examiner*—Nils E. Pedersen
*Attorney, Agent, or Firm*—Howson and Howson

[57] ABSTRACT

A dispenser for viscous materials such as toothpaste is disclosed. The dispenser comprises an elongated container having a spout at its upper end and a rockable finger actuator operable to dispense contents when depressed. The actuator is connected to an elongated operating rod which is coupled to a follower by means of a spray clutch which causes the follower to move upwardly in the container in increments in response to rocking motion of the actuator. The lower end of the operating rod is connected to a base member having a resilient portion and a peripheral recess which receives the lower end of the container. The resilient portion of the base member pulls the operating rod downwardly for repositioning the same after each stroke of the actuator, and the operating rod pulls upwardly on the base member to securely mount the same to the container.

10 Claims, 4 Drawing Figures

DISPENSER FOR VISCOUS MATERIALS

FIELD OF THE INVENTION

The present invention relates to dispensers for viscous materials, and more particularly, the present invention relates to a viscous material dispenser of the type having a container in which a follower is displaced axially toward a spout by an operating rod connected to an actuator.

BACKGROUND OF THE INVENTION

Various types of viscous material dispensers are known. Examples of such dispensers may be found in the following U.S. Pat. Nos.: 949,545; 1,212,010; 1,244,324; 1,668,511; 1,921,912; 2,151,684; 2,243,774; 2,557,952; 2,604,858; 2,732,101; 3,088,636; 3,215,320; 3,255,935; 3,361,305; 3,768,705; 4,154,371; 4,301,948; 4,413,759; 4,421,255; 4,437,584; 4,437,591; and 4,461,403. While the patented dispensers may function satisfactorily for their intended purposes, there is a need for a viscous material dispenser which is reliable in operation, which has a minimum of parts, and which is inexpensive to manufacture.

OBJECTS OF THE INVENTION

With the foregoing in mind, a primary object of the present invention is to provide a novel viscous material dispenser which overcomes the limitations of known viscous material dispensers.

Another object of the present invention is to provide an improved viscous material dispenser which is reliable in operation.

A further object of the present invention is to provide a unique viscous material dispenser which can be manufactured and filled economically utilizing a high-speed mass production equipment.

SUMMARY OF THE INVENTION

More specifically, the present invention provides an improved dispenser which is particularly suited for use in dispensing viscous materials, such as toothpaste. The dispenser comprises an elongated container having an upper end with a spout and a finger-actuated rocker arm actuator. An elongated operating rod is connected at its upper end to the actuator and depends therefrom axially inside the container where it is connected by a sprag clutch assembly to a follower. Rocking motion of the actuator causes the operating rod to reciprocate for advancing the follower upwardly in the container for dispensing contents from the spout. A base member has a resilient portion extending across the lower end of the container and engaging the lower end of the operating rod for biasing the same downwardly to reposition it relative to the follower after each dispensing stroke. A recess in the base member receives the lower end of the container and cooperates with the operating rod to securely mount the base member to the container.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENT

Figure 1:
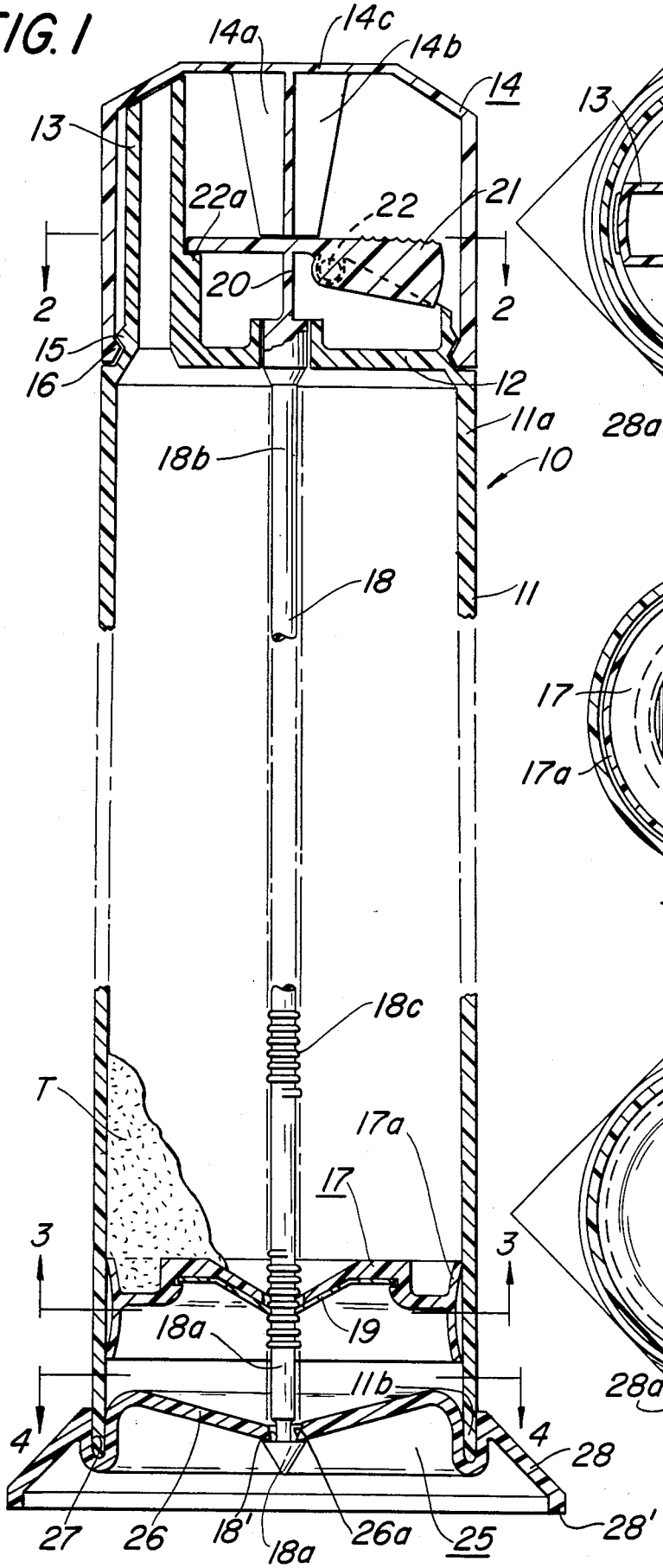
FIG. 1 is a longitudinal sectional view of a viscous material dispenser embodying the present invention.

Referring now to the drawings, FIG. 1 illustrates a dispenser 10 which embodies the present invention. The dispenser 10 is particularly suited for use in dispensing viscous materials such as toothpaste, shampoo, grease, etc. Accordingly, while reference hereinafter will be made to toothpaste, it should be understood that the dispenser of the present invention can be used to dispense a variety of products.

As best seen in FIG. 1, the dispenser 10 comprises an elongated tubular container 1 having an upper end 11*a* with a transverse end wall 12 and a lower end 11*b*. The lower end 11*b* terminates in a circular edge defining an opening through which the container 11 is filled when inverted. A dispensing spout 13 is formed integral with the upper end wall 12 of the container 11 and projects upwardly therefrom to one side of its longitudinal axis. An annular rib 15 on the end wall 12 cooperates with a complementary rib 16 on a cap 14 to hold the cap 14 in place on top of the container 11 in the manner illustrated in FIG. 1.

The container 11 is adapted to contain toothpaste T and to dispense the same from the spout 13 after the cap 14 has been removed. To this end, a follower 17 is mounted in the container 11 for movement axially therein to pressurize the toothpaste T. The follower 17 has a peripheral skirt 17*a* which engages the inner periphery of the container 11. The skirt 17*a* slidably engages the inside of the container 11 in a fluid tight manner to prevent the contents thereof from leaking.

The follower 17 is displaced upwardly in the container 11 by means of an operating rod 18. As best seen in FIG. 1, the operating rod 18 extends axially inside the container 11 for substantially its entire length. The operating rod 18 has a lower end 18*a* located adjacent to the bottom of the container 11, an upper end 18*b* located adjacent to the top of the container 11, and a series of annular ribs 18*c* spaced apart in increments along substantially its entire length.

Figure 3:
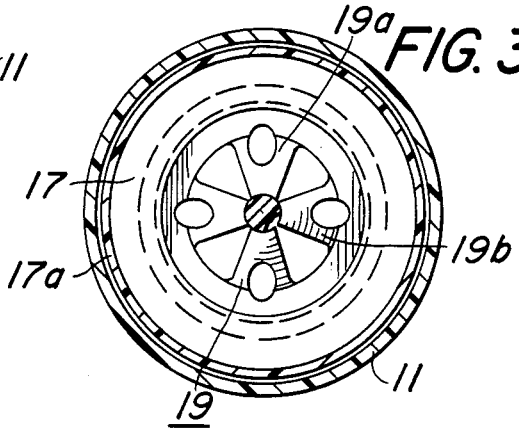
FIG. 3 is a sectional view taken on line 3—3 of FIG. 1.

The operating rod 18 is connected to the follower 17 by means which causes the follower 17 to move unidirectionally upward when the rod 18 is displaced upwardly. To this end, a metal-stamped sprag clutch assembly 19 having a series of flexible fingers 19*a*, 19*b* engages the operating rod 18 between the ribs 18*c* as shown in FIGS. 1 and 3 to grip the rod 18 in a downward direction so that when the rod 18 moves upwardly, it causes the follower to move upwardly with it. The sprag clutch assembly 19 permits the rod 18 to move downwardly relative to the follower 17 in a well known manner.

To displace the operating rod 18 upwardly, the upper end 18*b* of the operating rod 18 is connected by means of a flexible strap, or hinge, 20 to a rocker arm finger actuator 21 mounted in a trunnion 22 formed on the end wall 12 of the container 11. The strap 20 is molded integral with the rod 18 and the finger actuator 21 of the same plastic material. Pivotal movement, or depression, of the finger actuator 21 clockwise in the direction indicated by the arrow in FIG. 1 causes the operating rod 18 to move upwardly in the container 11, and this advances the follower 17 upwardly and applies pressure to the toothpaste T for causing it to flow out the spout 13.

A prior art dispenser of the type just described is disclosed in U.S. Pat. No. 4,437,591, the disclosure of which is incorporated by reference herein. In the patented dispenser, a spring element is provided for pivoting the finger actuator in the counterclockwise direction for urging the operating rod downwardly relative to the follower at the completion of a dispensing stroke to reposition the rod with respect to the follower and to ready the same for the next dispensing stroke. In this dispenser, the spring element is formed integral with the finger actuator and engages the upper end wall of the container for effecting the desired counterclockwise pivotal movement of the finger actuator. With this container, however, it has been necessary for the hinge to be fabricated of a special plastic material capable of sustaining the alternate tension and compression loads on the operating rod. While the operating rod itself can be fabricated of a low cost plastic, it has been necessary to fabricate the plastic material of the hinge of a more expensive grade of plastic, and this necessitates a more complex molding operation. Furthermore, in such containers, the hinge has been a source of failure of the product because of the repeated stressing of the hinge axially in opposite directions while undergoing flexure.

The present invention overcomes the aforementioned limitations of a known prior art container of the type described and provides a dispenser which is durable and yet which can be manufactured economically. To this end, a means is provided for maintaining downward tension on the operating rod so that the hinge is maintained in tension at all times. This is accomplished in the present invention by providing a base member 25 which functions both as a container base and as an operating rod biasing means.

Figure 2:
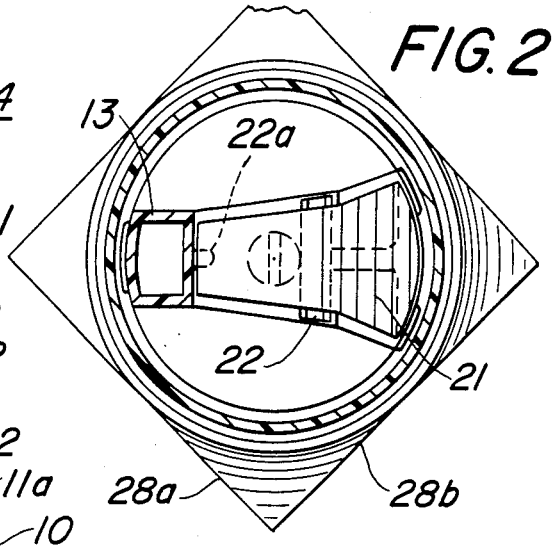
FIG. 2 is a sectional view taken on line 2—2 of FIG. 1.
Figure 4:
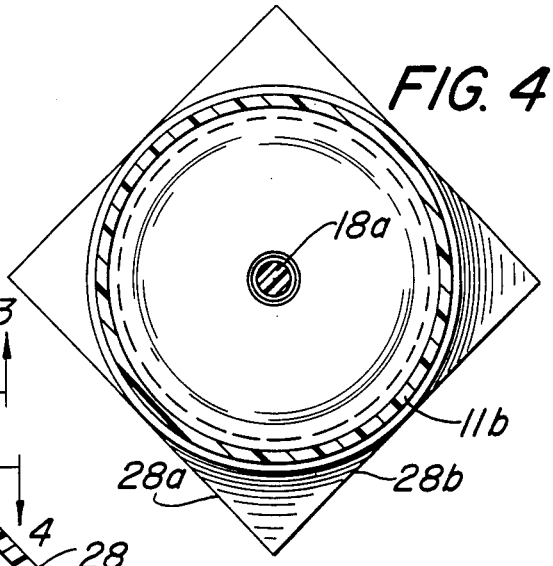
FIG. 4 is a sectional view taken on line 4—4 of FIG. 1.

To this end, and as best seen in FIG. 1, the base member 25 has a resilient wall portion 26 extending transversely across the lower end 11*b* of the container 11 and a peripheral recess 27 which receives and engages the lower end 11*b* of the container 11. The base member 25 has an outwardly extending and downwardly depending flared portion 28 with a lower edge 28' adapted to engage a support surface to support the container 11 upright. Preferably, the flared portion 28 has one or more straight sides 28*a*, 28*b* (FIGS. 2 and 4) to prevent the container 11 from rolling when laid on its side.

The base member 25 operatively engages the operating rod 18. For this purpose, the resilient wall portion 26 of the base member 25 has a central aperture 26*a* through which the lower end 18*a* of the operating rod 18 depends. The lower end 18*a* of the operating rod has an integral barbed head 18*c* having an annular shoulder 18' which engages the underside of the resilient wall portion 26 of the base member 25, and the head 18*c* is tapered in the manner illustrated. Thus, the base member 25 can be mounted on the lower end 11*b* of the container 11 and connected to the operating rod 18 simply by pushing the base member 25 axially with respect to the container 11 until the operating rod head 18*c* passes through the aperture 26*a* and the shoulder 18' engages the underside of the resilient wall 26.

The base member 25 positively biases the operating rod 18 downwardly. To this end, the resilient wall 26 has a concave, or dished, configuration, such as illustrated, and it deflects upwardly in response to upward movement of the operating rod 18 when the finger actuator 21 is pivoted clockwise in the direction indicated by the arrow.

In the illustrated embodiment, a stop surface 22*a* is provided adjacent to the spout 13 for engaging the finger actuator 21 to limit its pivotal movement in the counterclockwise direction. Thus, the stop 22*a* and trunnion 22 cooperate with the resilient wall portion 26 of the base member 25 to maintain tension on the operating rod 18 and its strap 20.

The cap 14 aids in the assembly of the dispenser 10 by stabilizing the position of the operating rod 18. To this end, the inside of the cap 14 is provided with a series of centrally located gussets 14*a*, 14*b* which depend from its end wall 14*c* and engage the topside of the finger actuator 21 in alignment with the strap 20 and operating rod 18 when the cap 14 is mounted on the container 11. The cap 14, and its gussets 14*a*, 14*b*, prevent the operating rod 18 from moving axially in the container 11 when the follower 17 is engaged with the operating rod 18 and the base member 25 is assembled onto the lower end 11*b* of the container 11 after the container 11 has been filled with toothpaste T. After engagement of the operating rod 18 and base wall 26 in the manner illustrated, the flexible wall portion 26 of the base member 25 applies a slight amount of tension to the operating rod 18, and thereby to the strap 20, for causing the finger actuator 21 to normally assume the home, or inactive, position illustrated in FIG. 1.

In use, the gap 14 is removed from the container 11 and the dispensing spout 13 positioned in dispensing relation with respect to the bristles of a toothbrush. A person then engages a thumb or finger with the finger actuator 21 and pivots the same clockwise in the direction of the arrow in FIG. 1. As the actuator 21 moves clockwise, it pulls upwardly on the strap 20 while flexing the same, and the strap 20, in turn, pulls upwardly on the operating rod 18. By virtue of the sprag clutch assembly 19 interconnecting the follower 17 with the operating rod 18, the follower 17 is pulled upwardly in the container 11 along with the operating rod 18.

As the follower 17 moves upwardly, it pressurizes the toothpaste T in the container 11, and this causes the toothpaste to flow out the spout 13. At the same time, the resilient flexible wall 26 of the base member 25 flexes upwardly by virtue of its interconnection with the lower end 18*a* of the operating rod 18 and the bottom of the container 11 continuing to maintain tension on the operating rod 18. When pressure is released from the finger actuator 21, however, the resilient wall 26 flexes downwardly toward the position illustrated in FIG. 1, enabling the sprag clutch 19 to permit the operating rod 18 to move downwardly with respect to the follower 17. The resilient wall 26 continues to pull the operating rod 18 downwardly until the finger actuator 21 engages its stop 22*a*. Thus, the finger actuator 21 is returned to its home position, and the follower 17 is reengaged with the operating rod 19 at a higher position to ready the dispenser 10 for the next dispensing stroke.

The container 10 may be stored upright in the manner illustrated in FIG. 1, or it may be laid down on its side without rolling as a result of the flat surfaces provided on the base member 25.

The aforedescribed structure has a number of advantages. First of all, the resilient wall portion 26 of the base member 25 exerts a relatively strong pull on the operating rod 18 to insure that it maintains the operating rod 18 under tension and causes it to reengage the follower at new location to be ready for the next dispensing stroke. Since the strap 20 does not undergo compressive stresses in use, it is fatigue resistant and therefore resistant to failure. Thus, the operating rod 18 and its strap 20, can be molded of the same low cost plastic in a straightforward molding procedure. The novel base member 25 provides, not only a means for biasing the operating rod 18 downwardly, but also a closure for the lower end of the container to prevent foreign matter from entering the same. Furthermore, the design of the base member 20 is such as to be capable of being molded in one piece and assembled readily with the container 11 simply by pushing the same together. Accordingly, the dispenser 10 of the present invention is not only economical to manufacture, but it is also durable and reliable in use.

While a preferred embodiment of the present invention has been described in detail, various modifications, alterations and changes may be made without departing from the spirit and scope of the present invention as defined in the appended claims.

We claim:

1. In a dispenser for viscous materials, including a tubular container having an end wall with a dispensing spout at its upper end and having a lower end, a rocker arm actuator pivotally mounted on the end wall, an operating rod connected to the rocker arm actuator and depending therefrom inside the container, a follower mounted in the container for movement along the operating rod, a sprag clutch interconnecting the follower and the operating rod for unidirectional motion toward the upper end wall in response to alternate movement of the operating rod in opposite directions, and means for biasing the operating rod downwardly to permit the sprag clutch to engage the operating rod at incremental locations, the improvement wherein said operating rod biasing means includes resilient base means extending across the lower end of the container and providing a closure for the same, said resilient base means engaging both the operating rod adjacent to its lower end and the lower end of the container for applying downward tension on the rod and causing the actuator connected thereto to return to a home position after having been pivoted therefrom to dispense viscous materials through the spout, said resilient base means having an aperture for receiving said operating rod and said operating rod having a portion depending through said aperture and having a head engaging the underside of the resilient means around the aperture to provide said operating rod tension, said resilient base means also having a recess for receiving the lower end of the container and for cooperating with said operating rod to mount said base to said container while providing said operating rod tension.

2. The dispenser according to claim 1 including a hollow cap releasably mounted on the upper end of said container and means in said cap engaging said finger actuator for limiting upward motion of the operating rod in the container.

3. The dispenser according to claim 2 wherein said cap has an end wall portion and said motion limiting means includes a series of gussets depending from said end wall portion and engaging said finger actuator in substantial alignment with said operating rod.

4. The dispenser according to claim 3 wherein said upper end of said container and said cap are provided with interengaging ribs to effect said releasable mounting of said cap to said container.

5. The dispenser according to claim 1 wherein said operating rod and said finger actuator are molded of one-piece plastic material and connected together by an integral flexible strap.

6. In a dispenser for viscous materials, including a tubular container having an end wall with a dispensing spout at its upper end, a rocker arm actuator pivotally mounted on the end wall, an operating rod connected to the rocker arm actuator and depending therefrom inside the container, a follower mounted in the container for movement along the operating rod, a sprag clutch interconnecting the follower and the operating rod for unidirectional motion toward the upper end wall in response to alternate movement of the operating rod in opposite directions, and means for biasing the operating rod downwardly to permit the sprag clutch to engage the operating rod at incremental locations, the improvement wherein said biasing means comprises a base member having a resilient portion extending across the lower end of said container and operatively engaging said operating rod adjacent to its lower end, said base member also having a recess receiving the lower end of said container, said resilient portion of said base member cooperating with the operating rod to tension the rod downwardly and to maintain the base member engaged with the lower end of the container.

7. In a dispenser for viscous materials, including a tubular container having an end wall with a dispensing spout at its upper end, a rocker arm actuator pivotally mounted on the end wall, an operating rod connected to the rocker arm actuator and depending therefrom inside the container, a follower mounted in the container for movement along the operating rod, a sprag clutch interconnecting the follower and the operating rod for unidirectional motion toward the upper end wall in response to alternate movement of the operating rod in opposite directions, and means for biasing the operating rod downwardly to permit the sprag clutch to engage the operating rod at incremental locations, the improvement wherein said biasing means comprises a base member having a downwardly concave resilient portion inside the container at its lower end and having an aperture receiving the operating rod, means carried by the operating rod for engaging the underside of the resilient portion of the base member and deflecting the same upwardly in response to upward motion of the operating rod, and means integral with said resilient portion of said base member providing a recess receiving the lower end of the container, said resilient portion of said base member cooperating with the operating rod to tension the rod downwardly and to maintain the base engaged with the container.

8. In a dispenser for viscous materials, including a tubular container having an end wall with a dispensing spout at its upper end, a rocker arm actuator pivotally mounted on the end wall, an operating rod connected to the rocker arm actuator and depending therefrom inside the container, a follower mounted in the container for movement along the operating rod, a sprag clutch interconnecting the follower and the operating rod for unidirectional motion toward the upper end wall in response to alternate movement of the operating rod in opposite directions, and means for biasing the operating rod downwardly to permit the sprag clutch to engage the operating rod at incremental locations, the improvement wherein said biasing means comprises a concave resilient member extending across the lower end of the container and having an aperture receiving the operating rod, the lower end of said operating rod having an integral head shaped to pass downwardly through said aperture and a shoulder on the head engaging the underside of the resilient member, the shoulder on the head normally pulling downwardly on the operating rod and upwardly on the resilient member to mount the same securely to the container.

9. In a dispenser for viscous materials, including a tubular container having an end wall with a dispensing spout at its upper end, a rocker arm actuator pivotally mounted on the end wall, an operating rod connected to the rocker arm actuator and depending therefrom inside the container, a follower mounted in the container for movement along the operating rod, a sprag clutch interconnecting the follower and the operating rod for unidirectional motion toward the upper end wall in response to alternate movement of the operating rod in opposite directions, and means for biasing the operating rod downwardly to permit the sprag clutch to engage the operating rod at incremental locations, the improvement wherein said biasing means comprises a base member having a resilient portion extending across the lower end of the container and an aperture receiving the lower end of the operating rod, said base member having a recess receiving the lower end of the container and a flared portion extending laterally outward and downward therefrom to provide a support located below the lowermost end of the operating rod, the operating rod having a barbed lower end portion engaging the underside of the resilient portion of the base member and cooperable therewith to simultaneously draw the operating rod downwardly in the container while pulling upwardly on the base member to mount the same securely to the container.

10. The dispenser according to claim 9 wherein said operating rod and finger actuator are molded of one-piece plastic material and connected together by an integral flexible strap, and including a cap releasably mounted on the upper end of said container, said cap having means integral therewith engaging said finger actuator for limiting upward motion of the operating rod in the container when said cap is installed thereon.

* * * * *